US008084721B2

(12) United States Patent
Mori et al.

(10) Patent No.: US 8,084,721 B2
(45) Date of Patent: Dec. 27, 2011

(54) ELECTRICAL HEATING APPARATUS, METHOD OF MANUFACTURING HEAT GENERATOR UNIT AND PRESSING JIG FOR USE IN MANUFACTURING THEREOF

(75) Inventors: Kazuaki Mori, Saitama (JP); Syotaro Abe, Saitama (JP)

(73) Assignee: Calsonic Kansei Corporation, Saitama-Shi (JP)

( * ) Notice: Subject to any disclaimer, the term of this patent is extended or adjusted under 35 U.S.C. 154(b) by 349 days.

(21) Appl. No.: 12/289,316

(22) Filed: Oct. 24, 2008

(65) Prior Publication Data

US 2009/0107985 A1 Apr. 30, 2009

(30) Foreign Application Priority Data

Oct. 26, 2007 (JP) ..... 2007-278499
Oct. 26, 2007 (JP) ..... 2007-278500

(51) Int. Cl.
*H05B 3/40* (2006.01)
*E04B 1/00* (2006.01)

(52) U.S. Cl. ..... 219/534; 219/202; 219/520; 219/537; 219/541; 219/544; 219/548; 219/553; 219/504; 219/505; 219/535; 392/503; 392/497; 392/502; 338/226; 52/741.1

(58) Field of Classification Search ..... 219/534, 219/202, 520, 537, 541, 544, 548, 553, 504, 219/505, 535; 52/741.1; 392/503, 497, 502; 338/226
See application file for complete search history.

(56) References Cited

U.S. PATENT DOCUMENTS

2005/0144896 A1* 7/2005 Hamburger ..... 52/741.1

FOREIGN PATENT DOCUMENTS

| | | |
|---|---|---|
| JP | 62-97284 | 5/1987 |
| JP | 5-1195 | 1/1993 |
| JP | 5-169967 | 7/1993 |

OTHER PUBLICATIONS

European Search Report issued Feb. 11, 2009 in the European Application No. EP08167428.5.

* cited by examiner

*Primary Examiner* — Shawntina Fuqua
(74) *Attorney, Agent, or Firm* — Wenderoth, Lind & Ponack, L.L.P.

(57) ABSTRACT

An electrical heating apparatus has: a fin brazed on at least one of a main body upper wall and a main body lower wall of a tube; an insertion unit having an electro-heat-generating element pressure-welded to a wall of one of the main body upper wall and the main body lower wall; and an edge part projecting in the width direction from each of main body vertical walls to form an edge space. The edge space is formed so as to be continuous with the insertion space and is smaller in thickness dimension than the thickness dimension of the insertion unit. The edge part has an edge part upper wall, an edge part lower wall, and an edge part vertical wall disposed in a concave shape.

5 Claims, 7 Drawing Sheets

ELECTRICAL HEATING APPARATUS, METHOD OF MANUFACTURING HEAT GENERATOR UNIT AND PRESSING JIG FOR USE IN MANUFACTURING THEREOF

CROSS REFERENCE TO RELATED APPLICATIONS

The present application is based on and claims priorities from Japanese Application Numbers 2007-278499 and 2007-278500, both filed on Oct. 26, 2007, the disclosures of which are hereby incorporated by reference herein in their entirety.

BACKGROUND OF THE INVENTION

1. Field of the Invention

The present invention relates to an electrical heating apparatus provided with a positive temperature coefficient (PTC) element which generates heat upon energization thereof (i.e., by passing electric current through the element). This element is herein referred to as an "energization heat-generating element" or "electro-heat-generating element." The invention also relates to a method of manufacturing a heat generator unit as well as to a pressing jig for use in the method of manufacturing the heat generator unit.

2. Description of the Related Art

There is known in, e.g., JP-A-5-169967, an electrical heating apparatus comprising a PTC element which generates heat upon energization thereof, and a plurality of laminated fins for radiating the heat of the PTC element.

As this kind of electrical heating apparatus, there is one in which an electrode plate and an insulating plate are sequentially laminated on an electro-heat-generating element, and the semi-product thus obtained is housed into an electrically conductive tube. The tube is then adhered, on an outside surface thereof, to fins by pressure welding or adhesion. This kind of electrical heating apparatus can generate heat as a result of energization (i.e., supplying of electricity) by connecting the electrode plate and the fins or tube to a positive pole and a negative pole, respectively, of the power source.

This kind of conventional art has the following problems. An electro-heat-generating element such as a PTC element, can neither smoothly generate nor radiate heat when the contact pressure relative to the electrode plate and to the tube is lower than a set pressure, resulting in a problem in that a sufficient amount of heat generation cannot be attained. In other words, when the contact pressure between the electro-heat-generating element and the tube is low, the heat generated in the electro-heat-generating element is not smoothly transmitted to the tube. In this case, the temperature of the electro-heat-generating element itself becomes high, and the value of resistance becomes high and, consequently, the energization and heat generation cannot be smoothly performed.

If the apparatus is provided with an urging member such as a spring for securing a contact pressure between the electro-heat-generating element and the tube, the number of constituent parts increases and the cost and weight increase.

On the other hand, it is also possible to fabricate the tube by pressing in order to secure a contact pressure between the electro-heat-generating element and the tube. In this case, it is difficult to press the tube (i.e., to fabricate the tube by press working) so as not to subject the tube to an excessive load in order to prevent the electro-heat-generating element housed therein from getting damaged. In addition, in case both end portions are pressed so as not to pressurize the electro-heat-generating element, the upper wall and the lower wall of the tube will be deformed in a manner to swell outside, resulting in incapability of obtaining the desired contact pressure.

Still furthermore, if the tube is pressed, the fins cannot be brazed to the tube in a step prior to the step of pressing. In addition, if the fins are brazed after the electro-heat-generating element has been inserted, the heat of brazing will damage the electro-heat-generating element.

Therefore, the fins will have to be brought into contact with, or adhered to, the tube without brazing. However, if the fins and the tube are brought into contact with, or adhered to, each other, the product thus obtained will be inferior in characteristics of heat transfer from the tube to the fins, as compared with a brazed one, resulting in lowering in the heat generating capacity.

As noted above, it has conventionally been difficult to: secure a contact pressure between the tube and the electro-heat-generating element without using an urging member; and to secure heat transfer performance from the tube to the fins to attain sufficient heat generating performance of the electro-heat-generating element.

SUMMARY OF THE INVENTION

The invention has been made by paying attention to the problems associated with the conventional art, and has an object of providing an electrical heating apparatus: in which the tube can be subjected to pressing (i.e., can be press-worked) after having brazed the fins to the tube; in which a contact pressure can be secured without subjecting the electro-heat-generating element to an overload; in which the contact pressure between the tube and the electro-heat-generating element as well as the heat transfer performance between the tube and the fins can be secured without using an urging member, thereby improving the heat generating performance of the electro-heat-generating element at a lower cost.

The invention has another object of providing a method of manufacturing a heat generator unit: in which a contact pressure between the tube and the electro-heat-generating element can be secured; and in which the heat transfer performance between the tube and the fins can be secured, thereby improving the heat generating performance of the electro-heat-generating element. The invention also has an object of providing a pressing jig which is used in the above-mentioned method of manufacturing the heat generator unit.

In order to attain the above and other objects, according to an aspect of the invention, there is provided a an electrical heating apparatus comprising: a cylindrical tube having an insertion space which is substantially rectangular in section, the insertion space being enclosed by: a main body upper wall and a main body lower wall, each of the walls being formed of an elongated thin plate and facing each other in a thickness direction of the tube; a pair of main body vertical walls lying opposite to each other in a width direction of the tube, the vertical walls being continuously formed on widthwise both ends of the main body upper wall and the main body lower wall; a fin brazed on an outside surface of at least one of the main body upper wall and the main body lower wall; and an insertion unit adapted for insertion into the insertion space. The insertion unit comprises: an electro-heat-generating element pressure-welded to one of the main body upper wall and the main body lower wall; an electrode in contact with the electro-heat-generating element; and an insulator interposed between the electrode and the other of the main body upper wall and the main body lower wall; and an edge part projecting in the width direction from each of the main body vertical walls to form an edge space, the edge space being continuous with the insertion space and being smaller in dimension in the thickness direction than the dimension of the insertion unit in thickness direction, the edge part having an edge part upper wall, an edge part lower wall, and an edge part vertical wall disposed in a concave shape.

According to another aspect of the invention, there is provided a method of manufacturing a heat generator unit, the heat generator unit comprising a tube having an insertion space enclosed by: a main body upper wall and a main body lower wall, each of the walls being formed of an elongated thin plate and facing each other in a thickness direction of the tube; and a pair of main body vertical walls lying opposite to each other in a width direction of the tube, the vertical walls being continuously formed on widthwise both ends of the main body upper wall and the main body lower wall; a fin brazed on an outside surface of at least one of the main body upper wall and the main body lower wall, the fin being located on the tube such that widthwise both ends thereof lie within an inside wall position of a widthwise outermost vertical wall while securing a pressing space between each of the ends of the fin and a widthwise end part on an outside of the tube; and an insertion unit adapted for insertion into the insertion space, the insertion unit comprising: an electro-heat-generating element pressure-welded to one of the main body upper wall and the main body lower wall; an electrode in contact with the electro-heat-generating element; and an insulator interposed between the electrode and the other of the main body upper wall and the main body lower wall. The method comprises: brazing the fin to the tube; inserting the insertion unit into the insertion space; and pressing the pressing space in a thickness direction of the tube to deflect the main body upper wall and the main body lower wall toward the insertion space, thereby obtaining, among the main body upper wall, the main body lower wall, and the insertion unit, a contact pressure larger than a set pressure but smaller than a critical contact pressure that damages the electro-heat-generating element.

An electrical heating apparatus according to an aspect of the invention comprises: a cylindrical tube (11) having an insertion space (11*a*) enclosed by: a main body upper wall (111) and a main body lower wall (112), each of the walls being formed of an elongated thin plate and facing each other in a thickness direction of the tube (11), and a pair of main body vertical walls (113, 113) lying opposite to each other in a width direction of the tube (11). The vertical walls (113, 113) are continuously formed on both widthwise ends of the main body upper wall (111) and the main body lower wall (112). The electrical heating apparatus further comprises: a fin (12) brazed on an outside surface of at least one of the main body upper wall (111) and the main body lower wall (112); an insertion unit (20) adapted for insertion into the insertion space (11*a*), the insertion unit (20) comprising an electro-heat-generating element (22) pressure-welded to one of the main body upper wall (111) and the main body lower wall (112); an electrode (23) in contact with the electro-heat-generating element (22); an electrical insulator (24) interposed between the electrode (23) and the other of the walls, and an edge part (114) projecting in the width direction from each of the main body vertical walls (113, 113) to form an edge space (11*b*), the edge space (11*b*) being continuous with the insertion space (11*a*) and having a smaller thickness dimension than the thickness dimension of the insertion unit (20). The edge part (114) has an edge part upper wall (114*a*), an edge part lower wall (114*b*), and an edge part vertical wall (114*c*) disposed in a concave shape.

In a method of manufacturing a heat generator unit according to another aspect of the invention, the heat generator unit comprises a cylindrical tube (11) having an insertion space (11*a*) enclosed by: a main body upper wall (111) and a main body lower wall (112), each of the walls being formed of an elongated thin plate and facing each other in a thickness direction thereof', and a pair of main body vertical walls (113, 113) lying opposite to each other in a width direction thereof, the vertical walls (113, 113) being continuously formed on both widthwise ends of the main body upper wall (111) and the main body lower wall (112). The heat generator unit further comprises a fin (12) brazed on an outside surface of at least one of the main body upper wall (111) and the main body lower wall (112). The fin (12) is located on the tube (11) such that both widthwise ends thereof lie within an inside wall position of a widthwise outermost vertical wall (114*c*) while securing a pressing space (114*a*, 114*b*) between each of the ends of the fin (12) and a widthwise end part on an outside of the tube (11). The heat generator unit further comprises an insertion unit (20) adapted for insertion into the insertion space (11*a*), the insertion unit (20) comprising: an electro-heat-generating element (22) pressure-welded to a wall of one of the main body upper wall (111) and the main body lower wall (112); an electrode (23) in contact with the electro-heat-generating element (22), and an insulator (24) interposed between the electrode (23) and the other of the walls. The method of manufacturing the heat generator unit comprises: brazing the fin (12) to the tube (11); inserting the insertion unit (20) into the insertion space (11*a*); and pressing the pressing space (11*a*) in a thickness direction of the tube (11) to deflect the main body upper wall (111) and the main body lower wall (112) toward the insertion space (11*a*), thereby obtaining, among the main body upper wall (111), the main body lower wall (112), and the insertion unit (20), a contact pressure larger than a set pressure but smaller than a critical contact pressure that damages the electro-heat-generating element (22).

DETAILED DESCRIPTION OF THE PREFERRED EMBODIMENTS

Figure 1:
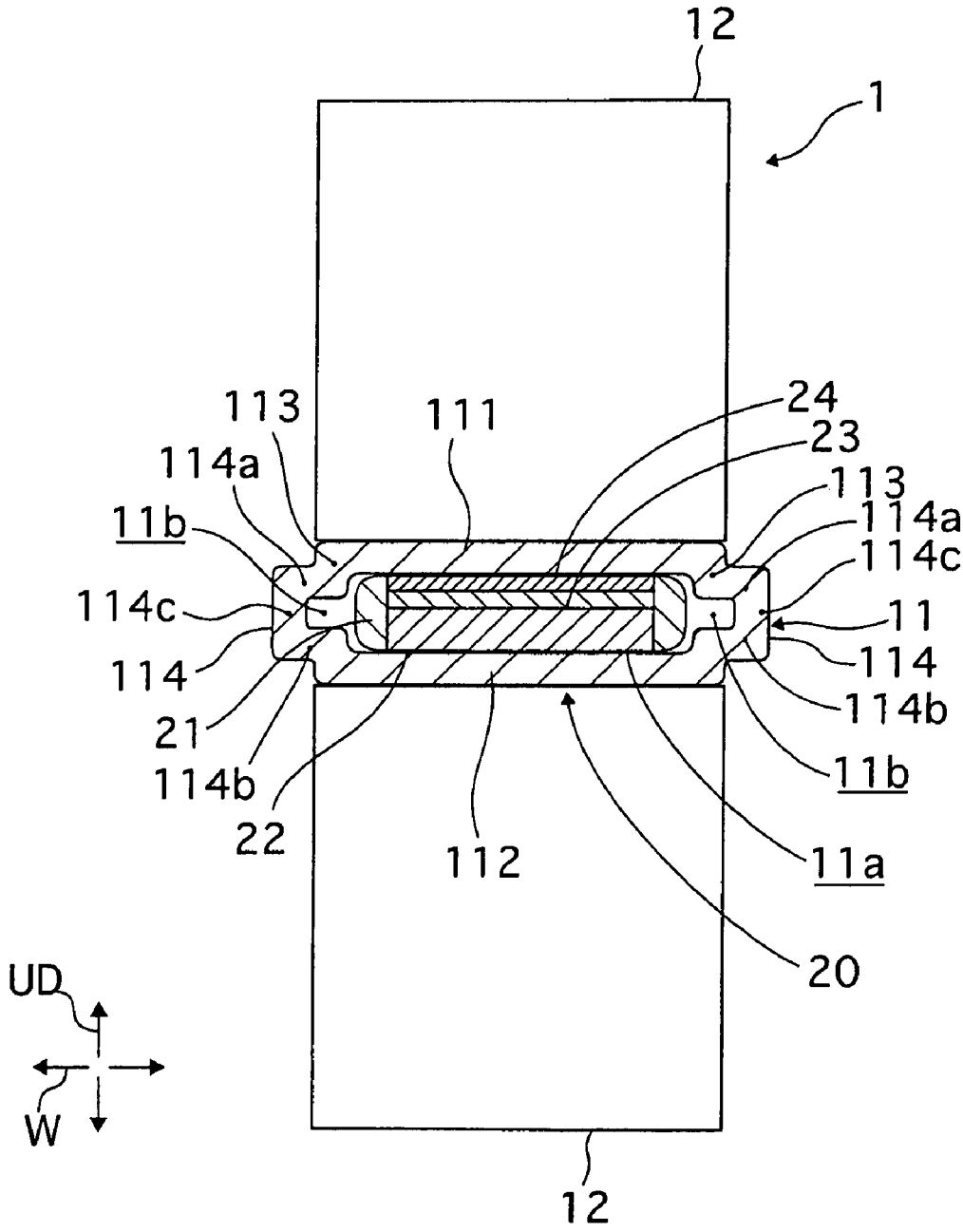
FIG. 1 is a sectional view, taken along line S1-S1 in FIG. 4, of a heat generator unit 1 which is used in an electrical heating apparatus A to be manufactured by a method of manufacturing according to embodiment 1 of the invention.
Figure 2:
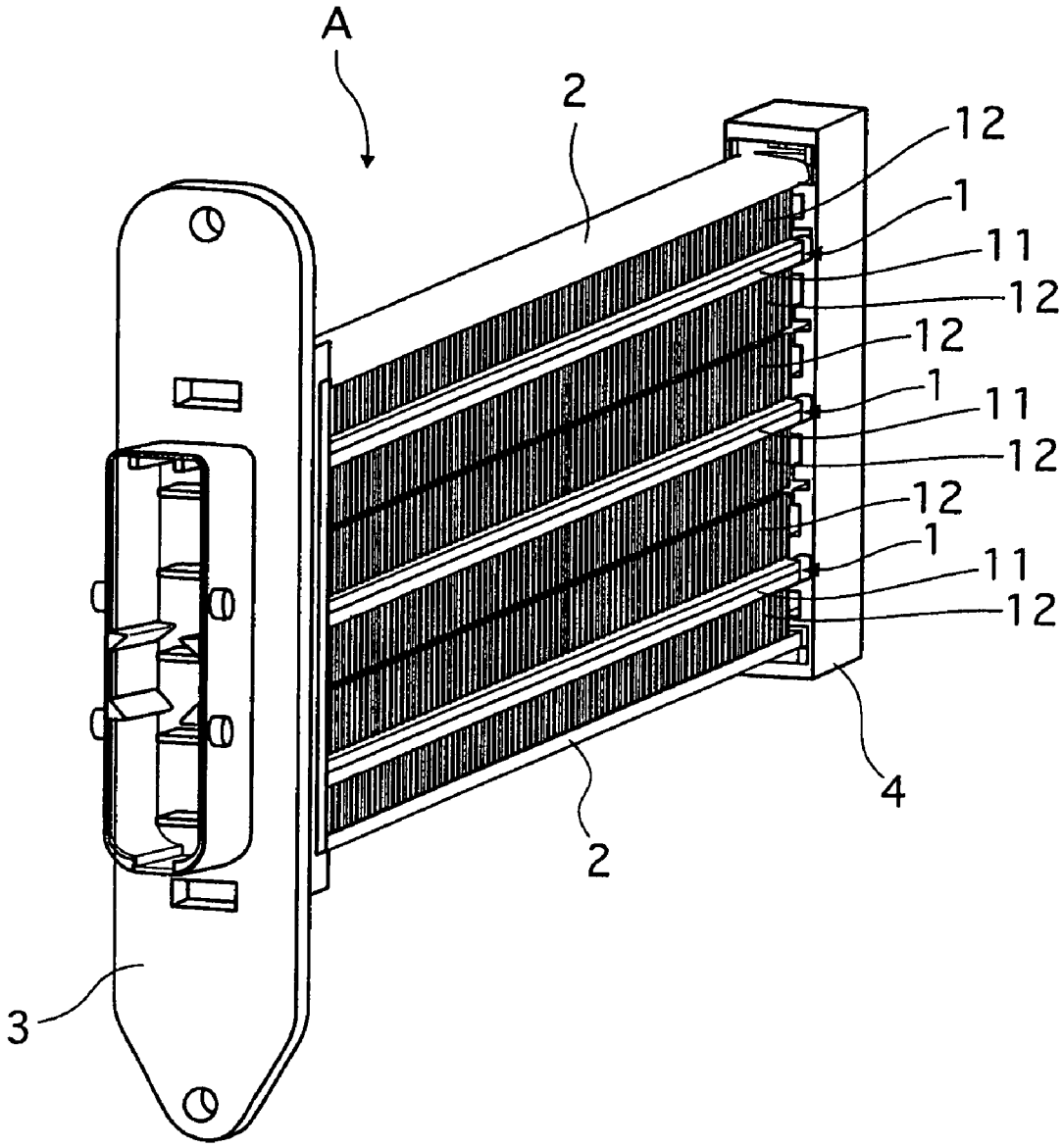
FIG. 2 is a perspective view of the electrical heating apparatus A.

With reference to FIGS. 1-7, a description will be made of an electrical heating apparatus A according to the best mode in embodiment 1.

The electrical heating apparatus A according to embodiment 1 is used, e.g., for heating the air to be introduced into an air conditioning unit for a vehicle (not illustrated). The electrical heating apparatus A is formed in the following manner.

Heat generator units 1, which are described in detail hereinafter, are vertically laminated in three stages. The semi-product thus obtained is covered on its upper side and lower side with end plates 2, 2, and its longitudinal ends are fixed by inserting them into a front housing 3 and an end housing 4, respectively.

The front housing 3 and the end housing 4 are made of a material such as fiber-reinforced polybutylene terephthalate (PBT) which is superior in electrical insulating characteristics and heat resistance. The fiber-reinforced PBT is low in water absorption and thermal expansion coefficient and is therefore stable in dimensional changes. It has further features in that it is superior in electrical insulation and small in change in electrical characteristics through moisture absorption, and that the dielectric breakdown voltage is high.

Figure 3:
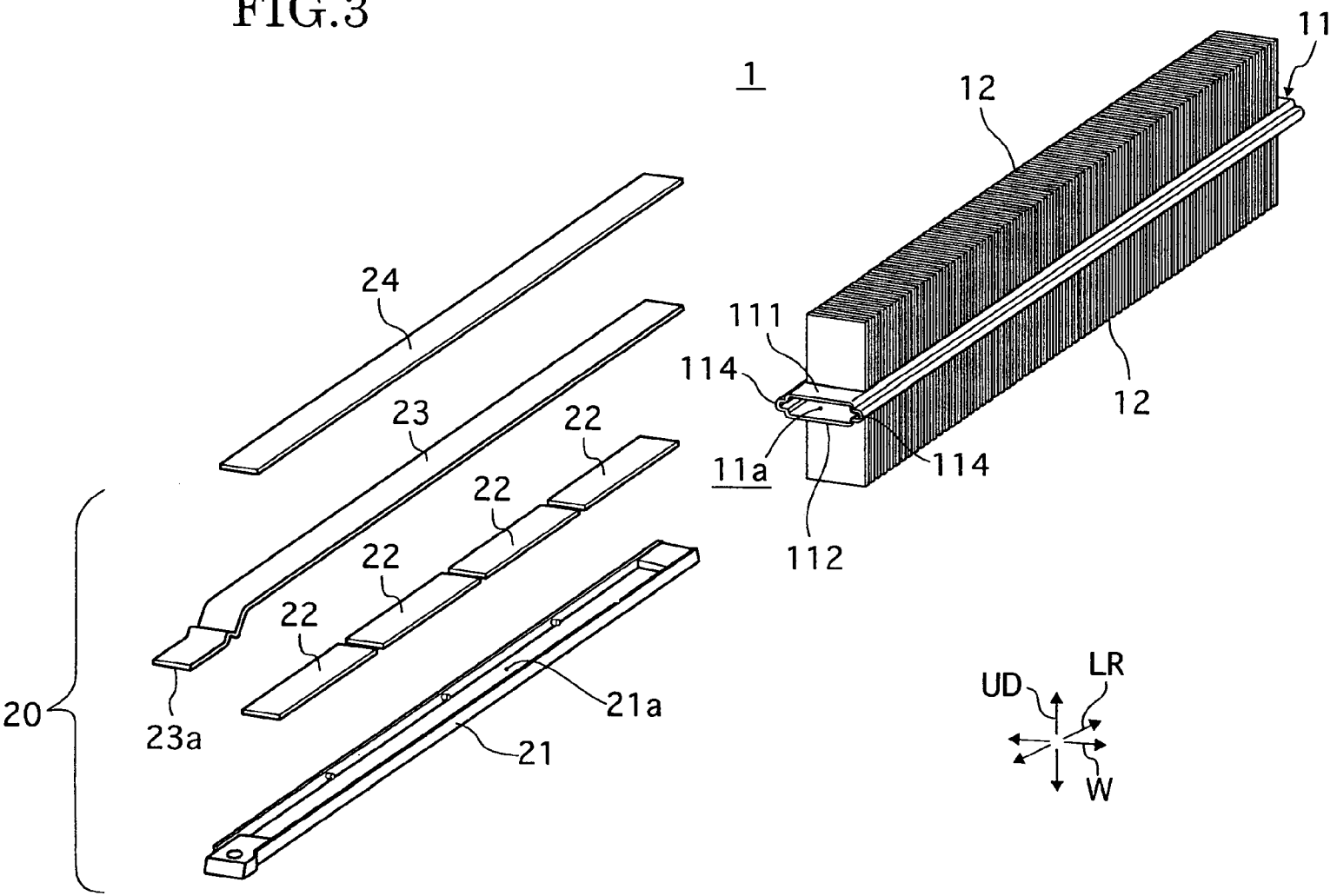
FIG. 3 is an exploded perspective view of the heat generator unit 1.
Figure 4:
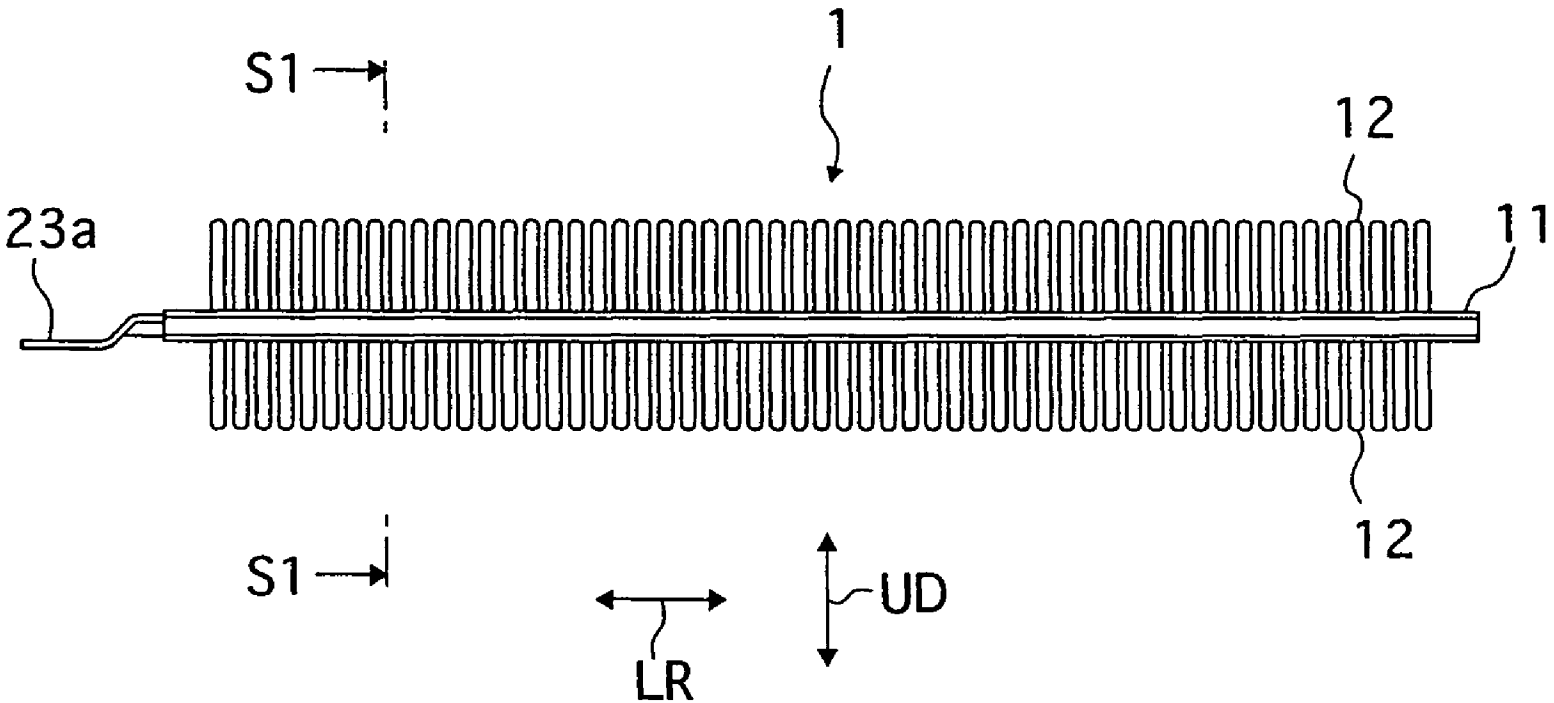
FIG. 4 is a side view of the heat generator unit 1.

The heat generator unit 1 is made up, as shown in FIG. 3, of a tube 11, fins 12, 12, and an insertion unit 20. The insertion unit 20 is made up of a holding frame 21, electro-heat-generating elements 22, 22, 22, 22, an electrode plate 23, and an insulating plate 24.

The tube 11 is formed by extrusion forming and the like of a metal (such as a plate material of aluminum, aluminum alloy, and the like) which is superior in thermal conductivity into a tube of substantially rectangular shape enclosing the insertion space 11*a*. The details of the shape will be given hereinafter.

The fins 12 are formed of a metal (such as a plate material of aluminum, aluminum alloy, and the like) which is superior in thermal conductivity into a corrugated shape. They are braided to a main body upper wall 111 and a main body lower wall 112 on both sides in a thickness direction (i.e., in the direction of an arrow UD) of the tube 11.

The holding frame 21 serves to hold a plurality of (four in this embodiment) electro-heat-generating elements 22, 22, 22, 22 at a predetermined distance from one another in a longitudinal direction (in the direction of an arrow LR). It is formed of a material which is superior in electrical insulation and heat resistance (e.g., polyamide and the like) into a substantially rectangular shape enclosing the rectangular supporting hole 21*a*.

Each of the electro-heat-generating elements 22 is formed of a semiconductive ceramics generally called a positive temperature coefficient (PTC) having a chief composition of barium titanate ($BaTiO^3$). It has characteristics to generate heat through energization (i.e., by passing electric current therethough). In this embodiment 1 the electro-heat-generating element 22 is formed of a thin plate shaped substantially into a rectangle and is fit into the supporting hole 21*a* of the holding frame 21 in a state of being arranged in the longitudinal direction (in the direction of the arrow LR).

The electrode plate 23 is a plate of rectangular thin plate as shown and has electrical conductivity. At one end of the electrode plate 23, a connection terminal 23*a* for connection to a connector (not illustrated) is formed by bending.

The insulating plate 24 is formed into a rectangle of a thin plate of a resin and the like having electrically insulating characteristics. Both the electrode plate 23 and the insulating plate 24 are formed into a width which allows them to be housed, together with the electro-heat-generating elements 22, in the supporting hole 21*a* of the holding frame 21. Further, as shown in FIG. 6, the dimension in the thickness direction in a state in which the electro-heat-generating elements 22, the electrode plate 23, and the insulating plate 24 are laminated together is arranged to be slightly larger than the thickness dimension of the holding frame 21.

The corner portions on a periphery of the holding frame 21 are chamfered, as shown, to form chamfered portions 21*b*, 21*b*, 21*b*, 21*b*.

The insertion unit 20 which holds in position in the supporting hole 21*a* the electro-heat-generating elements 22, the electrode plate 23, and the insulation plate 24, is inserted into the insertion space 11*a* of the tube 11.

Figure 5:
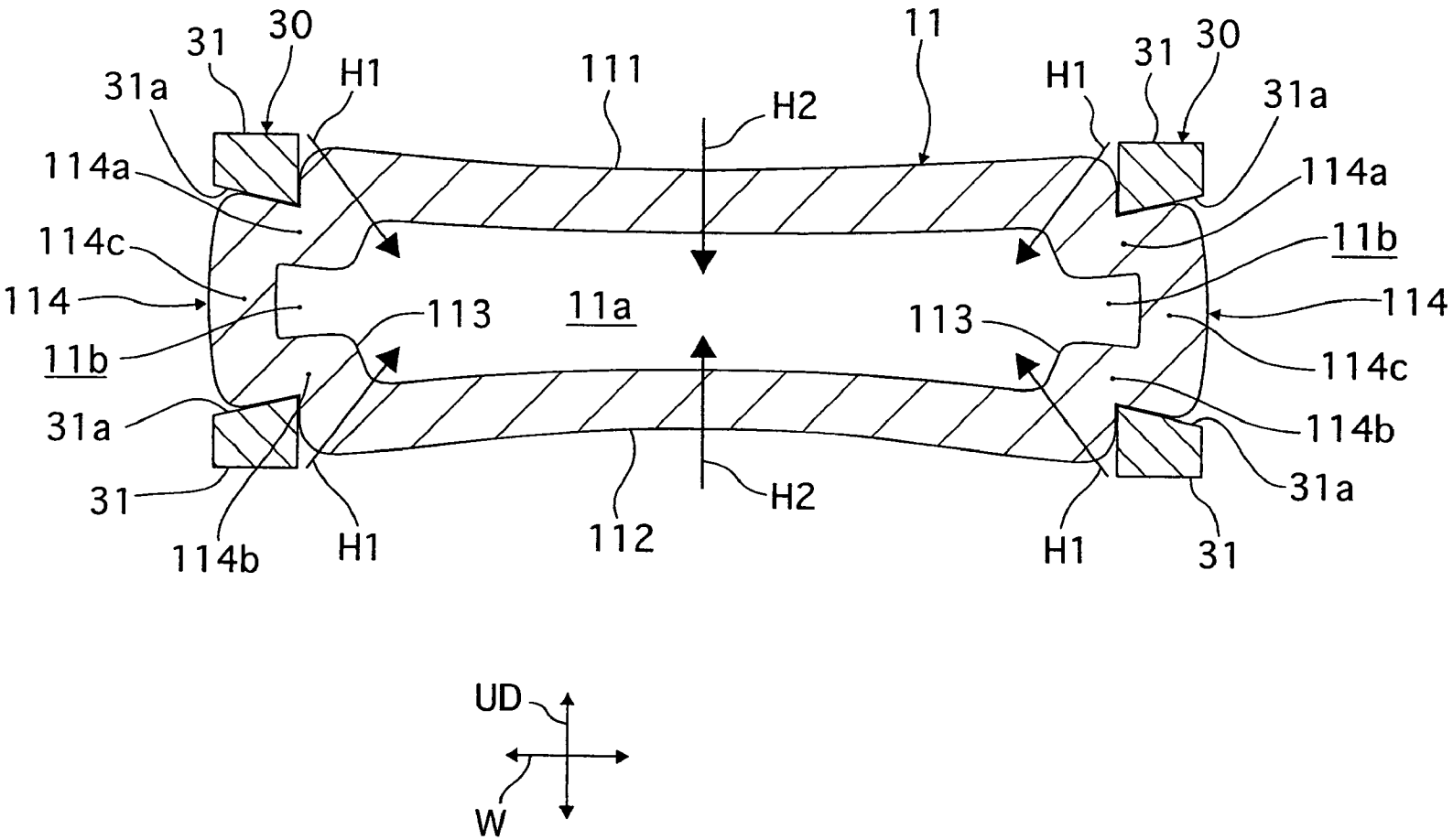
FIG. 5 is a sectional view explaining the deformation of the tube 11 in the pressing step.
Figure 6:
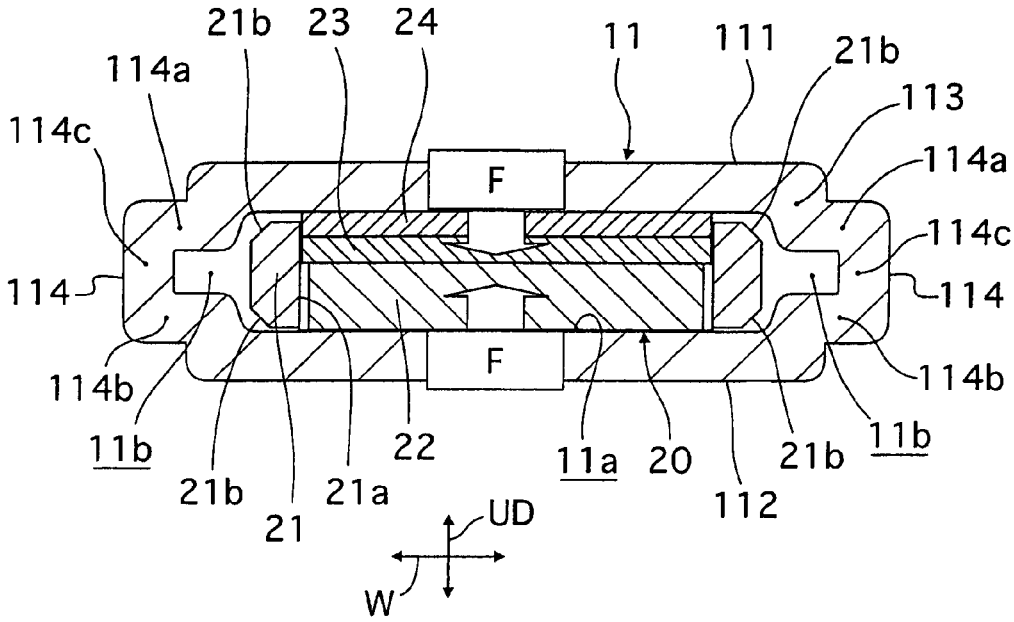
FIG. 6 is a sectional view explaining the state of contact between the tube 11 and the insertion unit 20.

With reference to FIGS. 5 and 6, a description will now be made about the details of the tube 11.

The tube 11 is formed into a tubular shape having the insertion space 11*a* of substantially rectangular shape in section. The insertion space 11*a* is enclosed by the main body upper wall 111 and the main body lower wall 112 which lie opposite to each other in the thickness direction of the tube 11, and a pair of main body vertical walls 113, 113 which are continuously formed on both widthwise (in the direction of an arrow W) end portions of the main body upper wall 111 and the main body lower wall 112.

From each of the main body vertical walls 113, there is integrally formed an edge part 114 in a manner to project outwardly in the width direction of the tube 11.

The edge part 114 is formed by an edge part upper wall 114*a* and an edge part lower wall 114*b* which lie opposite to each other, as well as an edge part vertical wall 114*c* which rises in the thickness direction of the tube 11, thereby forming an edge part space 11*b* which continues to the insertion space 11*a*.

The distance in the thickness direction between the edge part upper wall 114*a* and the edge part lower wall 114*b* is smaller than the distance in the thickness direction between the main body upper wall 111 and the main body lower wall 112. The thickness dimension of the edge part space 11*b* is smaller than the thickness dimension of the insertion unit 20.

In addition, the edge part vertical wall 114*c* is located such that the position of the inside side surface lies outside the position of the outside surface of the main body vertical wall 113. The edge part space 11*b* is elongated outside in the width direction beyond the main body vertical wall 113.

The outside surfaces of the edge part upper wall 114*a* and the edge part lower wall 114*b* correspond to pressing spaces to be subjected to pressing in the pressing step which is described in detail hereinafter. The edge part vertical wall 114*c* corresponds to an outermost vertical wall.

As described hereinabove, the tube 11 is provided therein with: the substantially rectangular insertion space 11*a* enclosed by the main body upper wall 111, the main body lower wall 112, and the main body vertical walls 113, 113; and the edge part space 11*b* which is elongated widthwise outside beyond the main body vertical wall 113 so as to be continuous with the insertion space 11*a*.

The insertion unit 20 is held inserted into the insertion space 11*a*, and the main body upper wall 111 and the main body lower wall 112 of the tube 11 are pressure-welded to the insertion unit 20. The main body lower wall 112 is pressure-welded to the electro-heat-generating elements 22 as shown.

The pressure welding of the main body upper wall 111 and the main body lower wall 112 to the insertion unit 20 is performed by pressing the edge part 114. The procedure of the press working will now be described hereinbelow. At the time of press working, as shown in FIG. 5, the edge part 114 is pressed by a pressing jig 30 from the upper and lower sides. As shown, the pressing jig 30 is provided with a pair of pressing members 31, 31 for pinching the edge part upper wall 114*a* and the edge part lower wall 114*b* from the upper and lower sides. The pressing members 31, 31 are each provided with an inclined pressing surface 31*a* which is inclined so as to effect a larger deformation inwardly at a position more away from the edge part vertical wall 114*c*, i.e., the inclined pressing surface 31*a* is configured such that the closer to the central side of the tube 11, the more inward projections in the pressing direction.

Therefore, when the edge part 114 is pressed as shown by the pressing members 31, 31, the edge part upper wall 114*a* and the edge part lower wall 114*b* will be deformed inward to a larger extent at positions which are away from the edge part vertical wall 114*c*. As a result of this deformation, the main body vertical wall 113 will be displaced inward in the direction of arrows H1, H1 at the corner portions of the main body upper wall 111 and the main body lower wall 112.

As a result of the deformation of the main body vertical wall 113, the main body upper wall 111 and the main body lower wall 112 are deformed at the widthwise central portion in the inward direction, i.e., in the direction as shown by arrows H2, H2 of the insertion space 11*a*.

In order to cause this kind of deformation to take place, it is necessary for the pressing portion of the pressing member 31 to lie within the inside surface of the edge part vertical wall 114*c*.

According to this configuration, as shown in FIG. 6, the main body upper wall 111 and the main body lower wall 112 are subjected to loads F, F relative to the insertion unit 20. The main body lower wall 112 can obtain a desired contact pressure relative to the electro-heat-generating elements 22.

Figure 7:
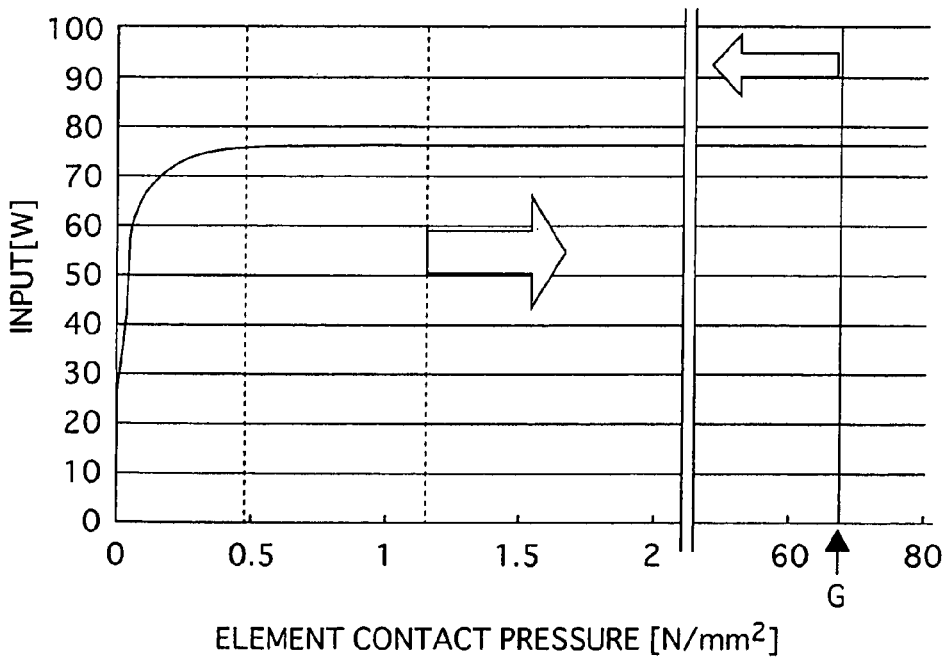
FIG. 7 is an input characteristics diagram showing the relationship between the contact pressure of electro-heat-generating elements 22 and tube 11 in the electrical heating apparatus A, and input (W) at the time of energization.

The desired contact pressure in embodiment 1 is set to a value, as shown in FIG. 7, which is larger than 0.5N/mm$^2$, preferably larger than 1.1N/mm$^2$ and which is far smaller than a critical contact pressure GN/mm$^2$ at which the electro-heat-generating elements 22 will be damaged. This contact pressure (element contact pressure) can be adjusted depending on the amount of deformation at the edge part 114.

FIG. 7 is an input characteristics diagram. As shown therein, it can be seen that a desired heat-generating performance can be obtained above the contact pressure in the neighborhood of above 0.5N/mm$^2$.

In the case of the electrical heating apparatus A of embodiment 1, since a desired contact pressure can be obtained between the tube 11 and the electro-heat-generating elements 22, the generated heat of the electro-heat-generating elements 22 at the time of energization is smoothly transmitted to the tube 11. As a result, the desired heat transfer characteristics can be obtained to thereby enable effective heat generation.

In addition, since the desired contact pressure between the tube 11 and the electro-heat-generating elements 22 can be obtained by pressing the edge part 114 of the tube 11, as compared with a configuration of providing the insertion space 11*a* of the tube 11 with an urging spring and the like which urges the electro-heat-generating elements 22, the number of constituent parts can be reduced, and the cost and weight can be reduced.

In addition, since the fins 12, 12 are braided to the tube 11, the heat transfer performance between the tube 11 and the fins 12 is higher, resulting in heat generation of higher efficiency, as compared with the configuration in which the fins 12 are simply brought into contact with the tube 12.

Further, since the edge part 114 of the tube 11 is subjected to pressing, the pressing is possible even in a state in which the fins 12 have been braided to the main body upper wall 111 and the main body lower wall 112, It follows that braiding becomes possible before insertion of the electro-heat-generating elements 22. As a result, there is no possibility of damaging the electro-heat-generating elements 22 by the heat during braiding.

In embodiment 1, the edge part space 11*b* is formed into a size which is smaller than the thickness of the insertion unit 20. Therefore, when the insertion unit 20 is inserted into the insertion space 11*a*, there is no possibility that the insertion unit 20 gets inserted into the edge part space 11*b*. As a result, at the time of pressing, the insertion unit 20 can surely be held in position in the insertion space 11*a* which is free from inputting of the pressing load. In this manner, the electro-heat-generating elements 22 can positively be prevented from being damaged by an overload at the time of press working.

As described hereinabove, the configuration according to embodiment 1 provides an electrical heating apparatus A which has the features in: that press working after the fins 12 have been braided is possible; that the electro-heat-generating elements 22 can be prevented from being subjected to overload at press working; that the contact pressure between the tube 11 and the electro-heat-generating elements 22 can be secured without using an urging member; that the number of constituent parts can be reduced, thereby enabling to manufacture the electrical heating apparatus at a lower cost; and that the heat generating performance of the electro-heat-generating elements 22 can be secured by securing the heat transfer performance between the tube 11 and the fins 12 and also by securing the contact pressure between the electro-heat-generating elements 22 and the tube 11.

In addition, since the edge part space 11*b* is elongated outward in the width direction beyond the main body vertical wall 113 of the tube 11, when the edge part 114 is pressed, the allowance for deformation in the thickness direction of the edge part 114 can be made large. As a result, the amount of deformation of the main body upper wall 111 and the main body lower wall 112 toward the insertion space 11*a* can be made large, whereby the contact pressure between the tube 11 and the electro-heat-generating elements 22 can be positively secured.

As a result, by securing the heat transfer efficiency between the electro-heat-generating elements 22 and the tube 11, the heat generating performance can be further improved.

In addition, the pressing members 31, 31 of the pressing jig 30 are each provided with the inclined pressing surface 31*a* in embodiment 1. Therefore, the edge part upper wall 114*a* and the edge part lower wall 114*b* can be deformed accompanied by an inward declining of the main body vertical wall 113 in a surer manner than a case in which the edge part 114 is pressed with a flat pressing surface.

According to this configuration, the main body upper wall 111 and the main body lower wall 112 can be brought into contact with the insertion unit 20 at a desired contact pressure. In other words, the electro-heat-generating element 22 and the main body lower wall 112 are brought into contact with each other at a desired contact pressure to thereby surely obtain a desired heat-generating performance.

Further, there is employed in embodiment 1 a configuration in which the insertion unit 20 is inserted into the tube 11. Therefore, the electrical heating apparatus can be manufactured in an easier manner than a case in which a plurality of members are combined together in forming a tube.

Still furthermore, the width dimensions of the main body upper wall 111 and the main body lower wall 112 of the tube 11 are made to coincide with the width dimensions of the fins 12, 12. Therefore, at the time of braiding the fins 12, 12 to the tube 11, the fins 12, 12 can be aligned (i.e., held in position) by making both widthwise ends of the fins 12, 12 coincide with both widthwise ends of both walls 111, 112.

According to this configuration, the fins 12, 12 can be aligned without the need of marking or fabricating marks for positioning the fins 12, 12, thereby improving the workability of braiding work at a low cost.

Further, in embodiment 1, chamfered portions 21*b* are formed on a periphery of the holding frame 21. Therefore, when the main body upper wall 111 and the main body lower wall 112 of the tube 11 are deformed inward at the time of press working to thereby contact the periphery of the holding frame 21, stress concentration can be alleviated. As a result, the main body upper wall 111 and the main body lower wall 112 can be prevented from giving rise to crimping. The reliability of obtaining a desired contact pressure can thus be improved.

In addition, because the electrode plate 23 is inserted into the inside of the tube 11 in embodiment 1, there can be obtained a structure in which the outside surface of the electrical heating apparatus A is free from potential difference. As a result, even if foreign matter is brought into contact with the surface of the electrical heating apparatus A, there is no possibility of causing a short circuit.

Furthermore, since the electro-heat-generating elements 22 are inserted into the tube 11 and the electro-heat-generating elements 22 are kept out of direct contact with the outside air, the electro-heat-generating elements 22 can be prevented from deteriorating in performance due to corrosion and the like thereof, resulting in improved durability.

Next, a description will now be made about the method of manufacturing the heat generator unit 1 of embodiment 1. This method includes a braiding process, an inserting process, and a pressing process.

Braiding Process

The braiding process is a process in which the fins 12, 12 are braided to the main body upper wall 111 and the main body lower wall 112, respectively.

In this braiding process, the width position of each of the end portions of the fins 12, 12 is aligned with the width positions of both end portions of the main body upper wall 111 and the main body lower wall 112 before proceeding to the braiding work.

Therefore, the positioning (or alignment) of the fins 12 can be made without the need for providing a mark for positioning. The workability of the braiding work can thus be improved at a low cost.

Inserting Process

The inserting process is a process in which the insertion unit 20 is inserted into the insertion space 11*a* of the tube 11 to which the fins 12, 12 have been braided.

In this inserting process, since the dimension of the edge part space 11*b* in the thickness direction is smaller than the insertion unit 20, the insertion unit 20 can surely be inserted into the insertion space 11*a* without getting wrongly inserted into the edge part space 11*b*.

Pressing Process

The pressing process is a process in which the edge part 114 is pressed (i.e., is subjected to fabrication by press working) to thereby bring the main body upper wall 111 and the main body lower wall 112 into urging contact with the insertion unit 20.

Other Embodiments

A description will now be made of another embodiment of carrying out the invention. The following embodiment is a modification to embodiment 1. Therefore, only what is different from embodiment 1 will be described and the same reference numerals as in embodiment 1 will be attached to the same constituent elements and explanation thereabout will be omitted. Explanation will also be omitted about the same function and effect as in embodiment 1.

Embodiment 2

Figure 8:
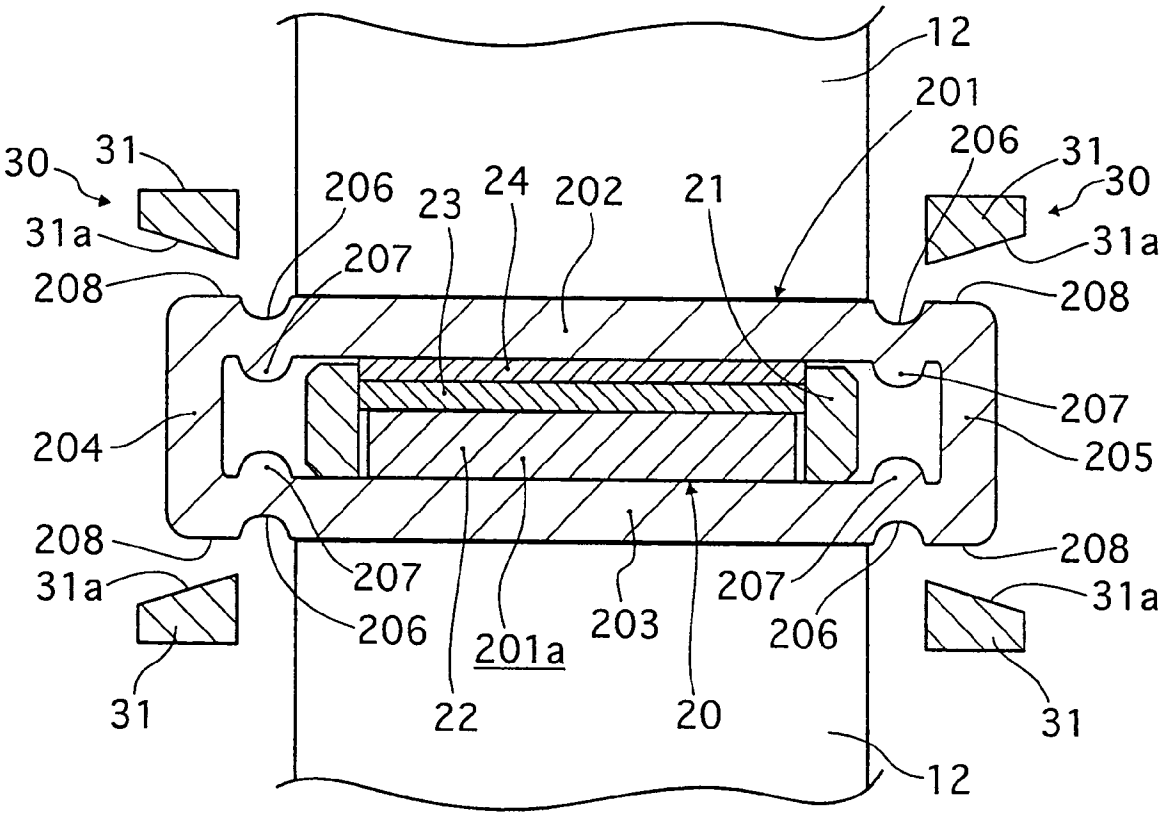
FIG. 8 is a sectional view showing the heat generator unit 200 to be manufactured by a method of manufacturing according to embodiment 2 of the invention.

With reference to FIG. 8, a description will now be made of the method of manufacturing the heat generator unit according to embodiment 2 of the invention.

Embodiment 2 is an example in which a substantially rectangular tube without the edge part 114 is employed as a tube 201 of a heat generator unit 200.

In other words, the tube 201 is formed into a substantially rectangular tube in cross section so as to enclose an insertion space 201*a* of substantially rectangular insertion space with a main body upper wall 202, main body lower wall 203, and main body vertical walls 204, 204.

Positioning groves 206, 206, 206, 206 to be used for positioning the width direction of the fins 12 are formed on both widthwise edge portions on an outside surface of the main body upper wall 202 and the main body lower wall 203. Also formed are convex strings 207, 207, 207, 207 which project on the inside surface of the widthwise both side edge portions.

On both widthwise sides of the tube 201, the portion lying outside the positioning groove 206 serves as the pressing space 208. The main body vertical walls 204, 205 correspond to an outermost vertical walls, and the pressing space 208 includes a region which lies on a further inside than both the main body vertical walls 204, 205.

Therefore, in the braiding process in embodiment 2, both widthwise sides of the fins 12 are disposed along the positioning recessed grooves 206, 206.

In the inserting process, positioning is made such that the insertion unit 20 does not overlap in the thickness direction with the pressing space 208 due to the convex strings 207, 207, 207, 207 when the insertion unit 20 is inserted.

It follows that, when the pressing spaces 208, 208 are urged or pressed by the pressing jig 30 in the pressing process, the pressing load can be prevented from being inputted into the electro-heat-generating elements 22 of the insertion unit 20, thereby preventing damage thereto by overload.

Further, in the pressing process, urging or pressing is performed on the pressing spaces 208, 208 which are disposed on the widthwise inner side than the main body vertical walls 204, 205. In this manner, the main body upper wall 202 and the main body lower wall 203 are deflected in a direction surely to narrow the insertion space 201*a* and are brought into pressing contact with the insertion unit 20.

As described hereinabove, also in embodiment 2, the tube 201 is press-worked after having braised the fins 12, 12 so as to secure the pressing pressure between the main body lower wall 203 and the electro-heat-generating elements 22. Therefore, like in embodiment 1, it is possible to secure the contact pressure between the tube 201 and the electro-heat-generating elements 22 without using an urging member and without damaging the electro-heat-generating elements 22 as a result of pressing. Therefore, there is an advantage in that: the heat generator unit 200 can be manufactured with a reduced number of constituent parts at a lower cost; and that the heat generator unit 200 can be manufactured in a manner to secure heat transfer efficiency between the tube 201 and the fins 12, 12, and also to secure a heat-generating performance of the electro-heat-generating elements 22 by securing the contact pressure between the electro-heat-generating elements 22 and the tube 201.

Description has so far been made of the embodiments of carrying out the invention as well as embodiments 1 and 2.

Concrete configuration, however, is not limited to the embodiments 1 and 2 of the invention.

In embodiment 1, an explanation has been made, e.g., of an example of applying the invention to an air conditioning apparatus for a vehicle. But the invention is not limited thereto, and is also applicable to household electrical appliances, industrial apparatuses other than vehicles, and the like.

An explanation has been made in embodiment 1 about an example of laminating the heat generator units 1 in three stages. But the invention is not limited thereto, and the purpose of the invention serves as long as one or more heat generator units are provided.

An explanation has been made in embodiment 1 of an example in which the fins 12 are braided to both the main body upper wall 111 and the main body lower wall 112 of the tube 12. However, the purpose of the invention serves if the fin 12 is braided to at least one of both walls 111, 112.

EFFECTS OF THE INVENTION

The electrical heating apparatus according to the invention is manufactured in the following steps, i.e., the fins are braided to the tube in advance, then the insertion unit which is made by laminating the electro-heat-generating elements, the electrode, and the insulator is inserted into the insertion space of the tube.

Since the thickness dimension of the edge part space is arranged to be smaller than the thickness dimension of the insertion unit, the insertion unit can be positioned, at the time of insertion, within the insertion space without getting inserted into the edge part space.

Then, the edge part is pressed in the thickness direction of the tube to thereby deform the edge part in the thickness direction. As a result, the main body upper wall and the main body lower wall of the tube can be subjected to inward load in the insertion space, whereby a desired contact pressure to the insertion unit can be obtained.

In this manner, without using an urging member such as a spring, the contact pressure can be secured between the electro-heat-generating elements and one of the main body upper wall and the main body lower wall that comes into contact therewith.

Since the insertion unit is not present in the edge part space, the electro-heat-generating elements can be prevented from getting damaged by inputting of an overload at the time of press working.

According to the electrical heating apparatus thus manufactured, since the tube and the fin are braided together, the heat transfer efficiency from the tube to the fins can be improved as compared with a case in which the tube and the fins are simply in contact with each other.

As a result, the heat generated at the electro-heat-generating elements can be smoothly discharged, resulting in an improvement in the heat-generating performance of the heat-generating apparatus.

In addition, since a high contact pressure can be obtained between the electro-heat-generating elements and the tube, the heat generated at the electro-heat-generating elements can be smoothly transmitted to the tube. Heat generation is thus possible while restricting an increase in the resistance in the electro-heat-generating elements. Energization and heat generation can therefore be smoothly performed, thereby resulting in an improvement in the heat-generating performance.

In addition, since an urging member to secure the contact pressure between the tube and the electro-heat-generating elements is not required, the number of constituent parts can be reduced and the cost and weight can also be reduced.

Furthermore, since the tube is provided with the edge part, the deformation of the edge part in the thickness direction thereof at the time of pressing can be easily deformed to a deflection deformation of the main body upper wall and the main body lower wall of the tube toward the insertion space. Therefore, as compared with a case in which the insertion space of the tube is pressed, the contact pressure can be obtained in a surer manner.

Still furthermore, since only the edge part is arranged to be pressed at the time of press working, press working is still possible even after the fins have already been braided to the main body upper wall and the main body lower wall. In this manner, the electro-heat-generating elements can be prevented from being damaged by the heat of braiding. In addition, at the time of pressing, the insertion unit can be prevented from being pressed, and the electro-heat-generating elements can be prevented from being damaged by the load at the time of pressing.

As described hereinabove, according to the invention, the electro-heat-generating elements are arranged to be prevented from being subjected to an overload at the time of press working after the braiding of the fins. A contact pressure between the tube and the electro-heat-generating elements can thus be secured without using an urging member, and the heat transfer performance between the tube and the fin as well as the contact pressure between the electro-heat-generating elements and the tube can be secured. An electrical heating apparatus can thus be provided in which the heat-generating performance of the electro-heat-generating elements is improved.

Further, since the electrical heating apparatus has a configuration in which the insertion unit is inserted into the tube, it can be manufactured easier than a case in which the tube is formed by combining a plurality of constituent members.

Preferably, the edge space projects beyond an outside of the main body vertical wall of the tube. Therefore, at the time of pressing the edge part, the allowance for deformation in the thickness direction of the edge part can be made larger. As a result, the amount of deformation of the main body upper wall and the main body lower wall toward the insertion space can be made large and, accordingly, the contact pressure between the tube and the electro-heat-generating elements can be secured more positively.

The heat transfer efficiency between the electro-heat-generating elements and the tube can thus be secured, and the heat-generating performance can be further improved.

Preferably, the width dimensions of the main body upper wall and the main body lower wall of the tube coincide with the width dimension of the fin. Therefore, when the fin is braided to the tube, the positioning or alignment of the fin becomes easy, resulting in superior workability.

Preferably, the electro-heat-generating element, the electrode, and the insulator are formed into a thin plate shape, respectively. The insertion unit has: a supporting hole for holding therein the electro-heat-generating element, the electrode, and the insulator in a state of being laminated or stacked in a thickness direction; and a holding frame formed into a frame shape to enclose the supporting hole. The holding frame has on a periphery thereof chamfered portions having chipped therefrom a corner part, respectively. Therefore, when the main body upper wall and the main body lower wall are deformed inward to thereby come into contact with the periphery of the holding frame at the time of press working, the stress concentration can be alleviated. The main body upper wall and the main body lower wall can thus be prevented from getting crimped, whereby the surety of obtaining a desired contact pressure can be improved.

According to another aspect of the invention, in the method of manufacturing the heat generator unit, the following steps are executed in sequence: the braiding step in which the fins are braided to the tube; the insertion step in which is inserted into the tube insertion space the insertion unit which is made by laminating the electro-heat-generating elements, the electrode, and the insulating member; and the pressing step in which the pressing space on a widthwise outside of the tube is pressed in the thickness direction to thereby deflect the main body upper wall and the main body lower wall of the tube toward the insertion space so as to obtain a desired contact pressure among the main body upper wall and the main body lower wall and the insertion unit.

The heat generator unit manufactured according to the above-described steps is capable of securing the contact pressure between the electro-heat-generating elements and one of the main body upper wall and the main body lower wall that comes into contact with the electro-heat-generating elements.

Therefore, the heat generated in the electro-heat-generating elements is smoothly transmitted to the tube, and heat generation is possible while preventing an increase in the resistance value of the electro-heat-generating elements. It is thus possible to smoothly perform energization and heat generation, thereby attaining an improvement in the heat generating performance.

In addition, since an urging member to secure the contact pressure between the tube and the electro-heat-generating elements is not required, the number of constituent parts can be reduced and the cost and weight can also be reduced.

Still furthermore, since the tube and the fins are braided together, the heat transfer efficiency from the tube to the fins can be improved.

As a result, the radiation of heat generated in the electro-heat-generating elements can be performed smoothly to thereby improve the heat radiation performance of the heat generating apparatus can be improved.

As described hereinabove, according to the invention, it is possible to obtain a heating unit at a lower cost by making it possible to secure the contact pressure between the tube and the electro-heat-generating elements without using an urging member, and to secure heat transfer performance between the tube and the fins, thereby improving the heat generating performance of the electro-heat-generating elements.

In addition, since the braiding of the fins to the tube is performed before the insertion of the insertion unit, the electro-heat-generating elements can be prevented from being damaged by the heat of braiding.

In the insertion step, since the insertion unit is arranged to be inserted into the insertion unit, manufacturing is easier than a case in which the tube is formed so as to enclose the insertion unit by a plurality of members.

In the pressing step, the press working is performed at both widthwise end portions which are free from braiding onto the portions which lie outside the fins but on the widthwise inner side than the inside wall surface of the outermost vertical wall of the tube. Therefore, the main body upper wall and the main body lower wall can be surely deflected inside toward the insertion space by press working. In this manner, by the press working after braiding, the contact pressure between the electro-heat-generating elements and the main body upper wall and the main body lower wall coming into contact therewith can surely be obtained by press working after having braided the fins.

Preferably, the main body vertical wall comprises an edge part projecting widthwise outward beyond the main body vertical wall so as to be continuous with the insertion space, the edge part having an edge part upper wall, an edge part lower wall, and an edge part vertical wall configured to be substantially in a U-shape to enclose an edge part space. The thickness dimension of the edge part space is smaller than the thickness dimension of the insertion unit. In the heat generator unit having the above configuration, the step of pressing the insertion space is performed by using the edge part upper wall and the edge part lower wall as the pressing space. As described above, since the edge part which is free from insertion of the insertion unit is subjected to press working at the pressing step, the electro-heat-generating elements can be prevented from being damaged by the pressing load at the time of press working. In addition, at the time of press working, the widthwise deformation of the edge part can be easily deformed into deflection deformation of the main body upper wall and the man body lower wall of the tube in the direction of the insertion space. Therefore, as compared with performing press working of the insertion space of the tube, the contact pressure can be easily obtained.

Preferably, the edge part is formed to be elongated, in the width direction, beyond the inside wall surface of the main body vertical wall, when the edge part is press-formed, the allowance for deformation of the edge part in the thickness direction can be made large. As a result, the amount of deformation of the main body upper wall and the main body lower wall toward the insertion space can be made large. The contact pressure between the tube and the electro-heat-generating elements can be secured more positively.

Further, at the time of press working, the pressing jig can prevent the braided fin from interfering with the main body upper wall and the main body lower wall of the tube to thereby prevent damaging to the fin.

Preferably, the width dimensions of the main body upper wall and the main body lower wall of the tube coincide with the width dimension of the fin. Further, since brazing of the fin is performed in a state in which both widthwise ends of the fin and both widthwise ends of at least one of the main body upper wall and the main body lower wall are made coincident with each other in position, the positioning of the fin relative to the tube at the time of brazing step becomes easy, resulting in superior workability.

Preferably, the contact pressure between the electro-heat-generating elements and the main body upper wall or the main body lower wall which comes into contact therewith is arranged to be 0.5 $N/mm^2$. Therefore, the heat transfer performance between the electro-heat-generating elements and the main body upper wall and the main body lower wall can be secured, and the heat-generating performance of the heat generator unit can be surely effected.

According to another aspect of the invention, the pressing jig comprises an inclined pressing surface for pressing the pressing space. The inclined surface is configured to gradually project inward toward a widthwise central side of the tube.

When both widthwise end portions of the tube are pressed in the thickness direction by a pair of pressing members at the time of press working, pressing is effected by means of the inclined pressing surfaces. Therefore, the portion lying further inside than the outside vertical wall portion is deformed to a larger degree than the outside vertical wall portion is deformed.

As a result, the main body upper wall and the main body lower wall are more likely to be deformed, and the contact pressure between the tube and the electro-heat-generating elements can be more securely obtained.

What is claimed is:

1. An electrical heating apparatus comprising:

a cylindrical tube having an insertion space with a substantially rectangular cross-section, said insertion space being formed and enclosed by:

a main body upper wall;

a main body lower wall, said main body upper wall and said main body lower wall each being formed of an elongated thin plate and being arranged to face each other in a thickness direction of said tube; and a pair of main body vertical walls lying opposite to each other in a width direction of said tube, said vertical walls being continuously formed on both widthwise ends of said main body upper wall and said main body lower wall;

a fin brazed on an outside surface of at least one of said main body upper wall and said main body lower wall; and an insertion unit housed in said insertion space, said insertion unit comprising:

an electro-heat-generating element pressure-welded to a first one of said main body upper wall and said main body lower wall;

an electrode in contact with said electro-heat-generating element; and an insulator interposed between said electrode and a second one of said main body upper wall and said main body lower wall;

wherein said tube comprises an edge part projecting in the width direction from each of said main body vertical walls to form an edge space therein, said edge space being continuous with said insertion space and has a thickness smaller than a thickness of said insertion unit, said edge part comprising an edge part upper wall, an edge part lower wall, and an edge part vertical wall arranged to have a concave shape;

wherein said edge part is configured such that said edge space projects beyond an outside surface of a respective one of said main body vertical walls of said tube; and wherein a width of said main body upper wall, a width of said main body lower wall, and a width of said fin all coincide.

2. The electrical heating apparatus of claim 1, wherein each of said electro-heat-generating element, said electrode, and said insulator has a thin plate shape, and wherein said insertion unit comprises a holding frame enclosing a supporting hole, said supporting hole being arranged to hold therein said electro-heat-generating element, said electrode, and said insulator stacked in the thickness direction of said tube.

3. The electrical heating apparatus of claim 2, wherein said holding frame has chamfered corner portions on a periphery thereof.

4. The electrical heating apparatus of claim 1, wherein said electro-heat-generating element comprises one of a plurality of electro-heat-generating elements of said insertion unit, said electro-heat-generating elements being arranged within said insertion space a predetermined distance from each other along a longitudinal direction of said insertion unit.

5. The electrical heating apparatus of claim 1, wherein said fin comprises one of a plurality of metal fins braided to said main body upper wall and said main body lower wall of said tube.

* * * * *